United States Patent [19]

Johnston et al.

[11] Patent Number: 4,704,075

[45] Date of Patent: Nov. 3, 1987

[54] TURBOCHARGER WATER-COOLED BEARING HOUSING

[76] Inventors: Andrew E. Johnston, 16735 Index St., Granada Hills, Calif. 91344; Jon A. Meyer, 13273 Bracken St., Arleta, Calif. 91331; Ronald Miller, 13920 Old Harbor La., Marina del Rey, Calif. 90272

[21] Appl. No.: 822,261

[22] Filed: Jan. 24, 1986

[51] Int. Cl.[4] ..... F04B 17/00

[52] U.S. Cl. ..... 417/407

[58] Field of Search ..... 417/405, 406, 407; 60/602

[56] References Cited

U.S. PATENT DOCUMENTS 2,159,422 5/1939 Buchi ..... 417/407
3,969,804 7/1976 MacInnes et al. ..... 417/407
4,107,927 8/1978 Gordon, Jr. et al. ..... 417/407
4,235,484 11/1980 Owen et al. ..... 417/407

FOREIGN PATENT DOCUMENTS 178828 10/1983 Japan ..... 417/407

*Primary Examiner*—Louis J. Casaregola
*Assistant Examiner*—Timothy S. Thorpe
*Attorney, Agent, or Firm*—Cislo & Thomas

[57] ABSTRACT

A water-cooled turbocharger is fabricated employing a coreless die casting process. Instead of casting a complete passage in the bearing housing of the turbocharger, an open ended channel is cast into the housing and then sealed off by a mating seal plate. O-rings or other sealing materials are used to seal the mating joints to prevent pressurized cooling water from leaking to the outside or into the internal bearing housing area.

15 Claims, 5 Drawing Figures

TURBOCHARGER WATER-COOLED BEARING HOUSING

BACKGROUND OF THE INVENTION

This invention relates to turbochargers and, more particularly, to a unique water-cooled bearing housing for a turbocharger.

The present invention concerns a water-cooled turbocharger that has important performance and manufacturing advantages over the existing prior art.

Conventionally designed turbochargers used in automotive and other high temperature applications have been experiencing an increasingly high failure rate due to an phenomenom known as "oil coking". This occurs after the engine is shut down and the heat stored up in the exhaust manifold and turbine housing soaks back into the turbocharger bearing housing. The bearing housing temperature increases until it reaches the temperature required to burn oil. Any oil remaining in the bearing housing is then burned into a thin film of "coke". This process continues until the accumulation of coke deposits completely plugs up the small oil passages. This results in oil starvation to the bearings and then complete failure of the turbocharger rotating assembly.

This problem has been addressed in previous art by using water to cool the bearing housing to prevent it from reaching the temperature required to burn oil. This has been accomplished by casting a water passage into the bearing housing and then circulating engine cooling water through the passage. Prior art designs have used passages that were completely contained within the bearing housing casting. This design requires a casting process with a core, and therefore limits the castings options accordingly.

One important casting method that cannot be easily used with the prior designs is die casting. Die casting has several manufacturing advantages when used to make turbocharger bearing housings. Aluminum die casting housings have excellent heat transfer characteristics, thereby allowing faster heat transfer of the heat around the bearings to the water passage. Die casting is one of the most economical methods of casting. Die cast parts are also near net shape and can be easily designed for a minimum of machining operations, thereby further reducing the cost of the finished part when compared to parts that are cast by a casting process that requires a core.

A need remains to provide a water-cooled turbocharger bearing housing that may be die cast without a core.

OBJECTS AND SUMMARY OF THE INVENTION

Accordingly, it is an object of the present invention to provide a water-cooled turbocharger bearing housing that may be die cast without a core.

It is a further object of the present invention to provide a means for sealing a water-cooled turbocharger bearing housing assembly to prevent water from leaking to the outside or into the internal bearing housing area.

It is a still further object of the present invention to provide a water-cooled turbocharger which is easily disassembled and in which any deposits in the water passage may be accessible for removal during rebuilding of the turbocharger.

It is yet another object of the present invention to provide a means for preventing oil from leaking into the compressor section of a turbocharger from the bearing housing section.

These and other objects of the invention will become more apparent upon a consideration of the drawing taken in conjunction with the following commentary.

Briefly, a turbocharger is provided comprising a compressor section, a turbine section and a bearing housing, intermediate the compressor section and the turbine section. The compressor section incudes a fluid medium inlet, a fluid medium outlet, an annular discharge passage communicating therebetween and a compressor impeller mounted on one end of a shaft. The turbine section includes a fluid medium inlet, a fluid medium outlet, an annular inlet passage communicating therebetween and a turbine wheel mounted on the opposite end of the shaft. The bearing housing includes a lubricating oil inlet passage, means for introducing oil around the shaft, and means for discharging the oil. The turbine section is clamped to one side of the bearing housing. Means are provided between the bearing housing and the compressor section and between the bearing housing and the turbine section for minimizing leakage of oil therebetween.

In accordance with the invention, instead of casting a complete, self-contained water passage in the bearing housing, an open ended channel is cast into the housing and then sealed off by a mating seal plate. O-rings or other sealing materials are used to seal the main joints to prevent pressurized cooling water from leaking to the outside or into the internal bearing housing area. The seal plate is attached to one side of the compressor section and the bearing housing is attached to the seal plate.

Advantageously, by having the channel open on one side, the channel can be made by a coreless die casting process. This design also facilitates the removal of any accumulated deposits in the water passage during rebuilding of the turbocharger.

In an alternate embodiment, an open channel may be provided on the turbine side, employing a second sealing plate. By providing two seal plates, one on the compressor side and one on the turbine side, the construction of through water passages may be facilitated. Also, such construction permits the use of superior materials on the turbine side, for demanding applications.

DETAILED DESCRIPTION OF THE PREFERRED EMBODIMENTS

Figure 1:
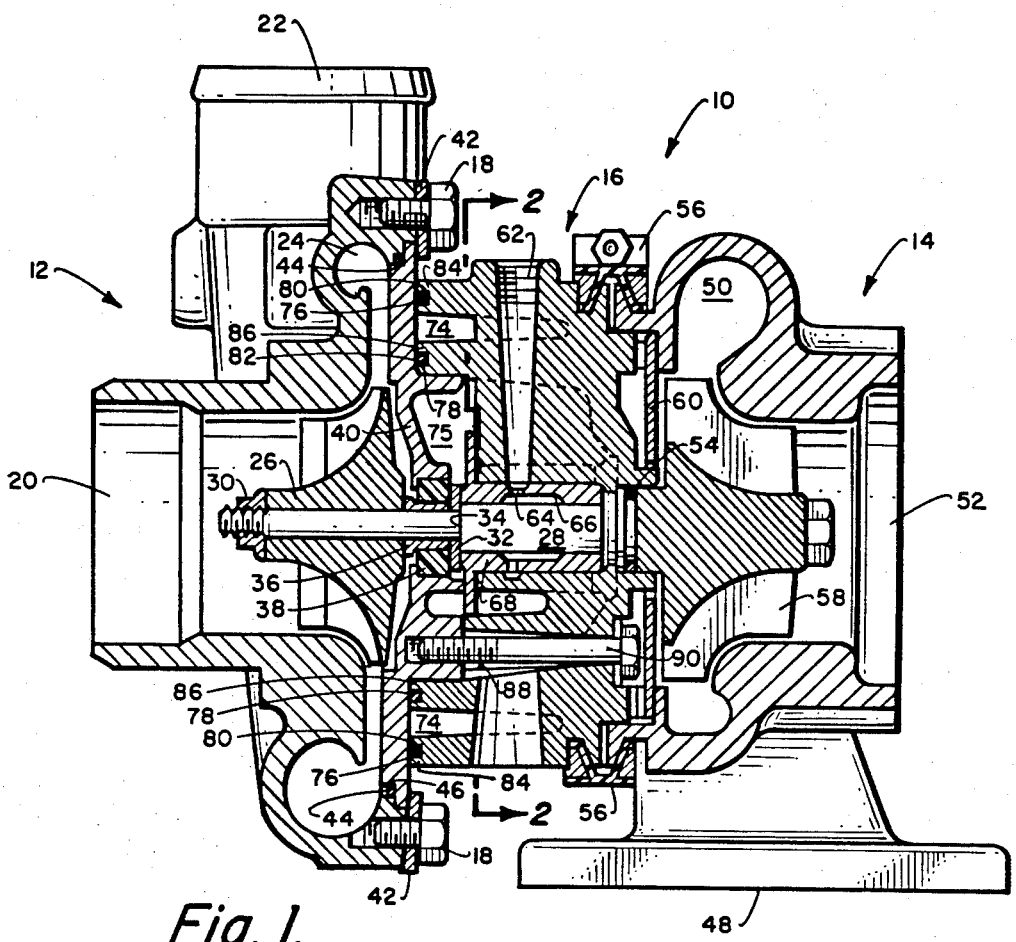
FIG. 1. is a side elevational view, partly in longitudinal section, illustrating apparatus constructed in accordance with the invention.

Referring now to the drawing, wherein like numerals of reference designate like elements throughout, a turbocharger, generally indicated by the numeral 10, comprises three major portions: a compressor section 12, a turbine section 14 and, intermediate both sections, a bearing housing 16. The compressor section 12 is secured to the bearing housing 16 by suitable means, such as bolts 18. The compressor section 12 is provided with a fluid medium inlet 20, a fluid medium outlet 22 and an annular discharge passage 24 communicating therebetween. Compressor impeller means 26 are mounted on a shaft 28 common with a turbine wheel means 58, and secured to the shaft by means such as nut 30. A mating ring 32 is urged against a shoulder 34 on the shaft 28 and is spaced from the compressor impeller means 26 by a spacer 36. A face seal 38 is provided to prevent leakage of oil from the bearing housing 16 into the compressor section 12. A seal plate 40, discussed in greater detail below, supports the face seal 38. The seal plate 40 is attached to the compressor section 12 by a portion of a clamp plate 42 on bolt 18 and is sealed thereto by O-ring 44, maintained in a groove 46 of the compressor housing 12.

The turbine section 14 includes a fluid medium inlet 48 and an annular inlet passage 50 which communicates with a discharge outlet 52. Piston seal ring 54 prevents passage of fluid medium into the bearing housing 16. The bearing housing 16 may be secured to turbine housing 14 by any suitable means, such as annular V-clamp 56. The turbine wheel 58 is secured to the shaft 28 by any suitable means, such as brazing, welding, soldering and the like, for rotation therewith. Alternatively, a one piece casting may be employed. A heat shield 60 is employed for reducing heat transfer into the bearing housing 16 from the exhaust gases used to drive the turbine wheel 58.

A lubricating oil inlet passage 62 if formed in bearing housing 16, which communicates with a passage 64 for introducing oil to an annular recess 66 formed in a sleeve bearing 68.

Figure 2:
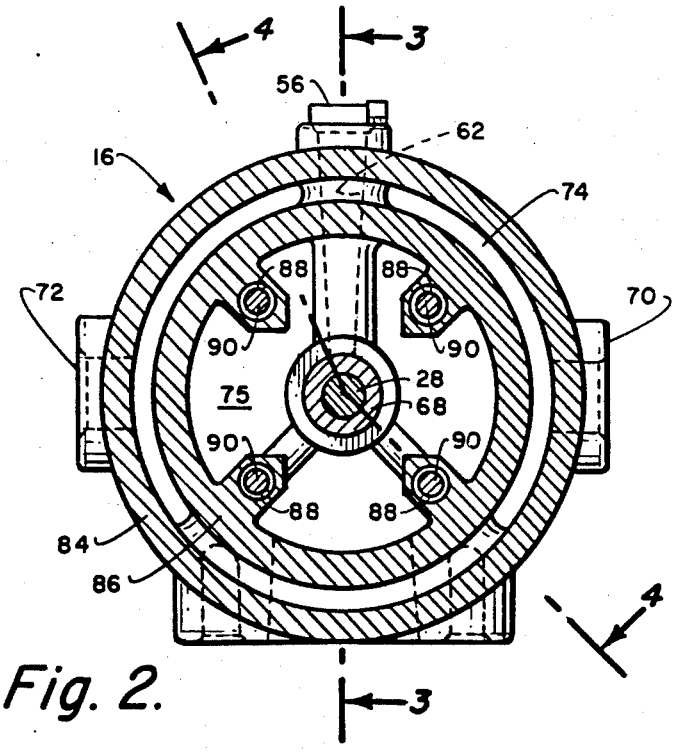
FIG. 2 is a cross-sectional view taken along the line 2—2 of FIG. 1.
Figure 3:
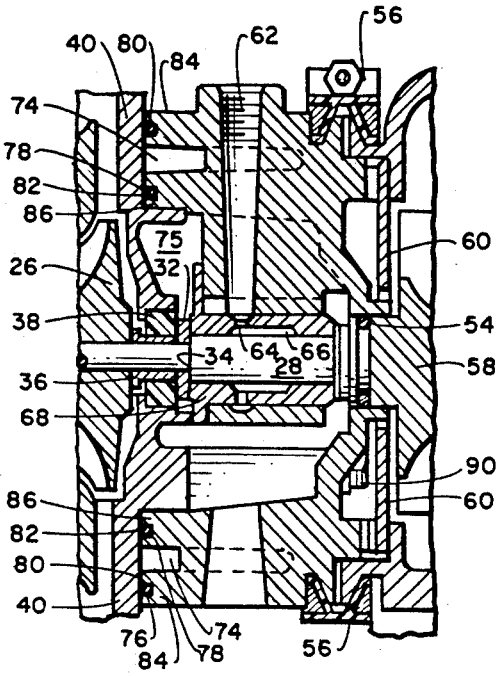
FIG. 3 is a cross-sectional view taken along the line 3—3 of FIG. 2.
Figure 4:
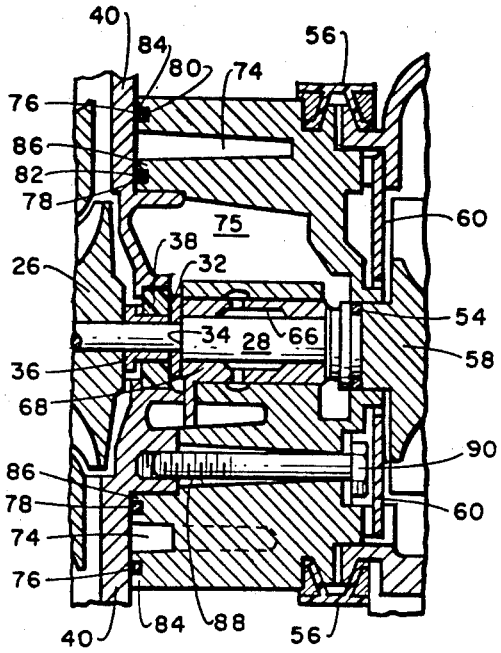
FIG. 4 is a cross-sectional view taken along the line 4—4 of FIG. 2.

After the oil flows along the bearing, it flows by gravity to the bottom of the bearing housing 16, where it is returned to the crankcase of the engine. Cooling, if desired, is accomplished by introducing water or other cooling medium at an inlet 70 and discharging the same from outlet 72, as best seen in FIG. 2. An annular passageway 74 in the bearing housing 16 communicates between the cooling inlet 70 and the cooling outlet 72.

The foregoing elements, but for the seal plate 40 and bearing housing configuration, are commonly found on conventional turbochargers, and thus do not form a part of this invention. The particular selection of seals, bearings and the like is immaterial in the practice of the invention, and is conveniently that suitably employed in the art.

In accordance with the invention, a coreless cast water-cooling passage is provided by fabricating a bearing housing and seal plate assembly as shown in the drawing. Instead of casting a complete passage in the bearing housing, an open ended channel, or annular passageway 74, is cast into the housing 16 and then sealed off by mating seal plate 40. Sealing is accomplished by use of O-rings 76 and 78 seated in grooves 80 and 82, respectively, in concentric rings 84 and 86, respectively, which define the annular passageway 74. Alternatively, other sealing materials, such as gaskets, may also be employed. An interior recess 75 is defined by the inner concentric ring 86.

The O-rings are used to seal the mating joints to prevent pressurized cooling water from leaking to the outside of the internal bearing housing area or into the internal bearing housing area. By having the channel 74 open on one side (the compressor side) as shown, the channel 74 may be made by a coreless die casting process. This construction also facilitates the removal of any accumulated deposits in the water passage during rebuilding of the turbocharger 10.

Another advantage of the inventive approach is that the same casting can be used for both water-cooled and non-water-cooled applications without a sufficient cost penalty. This is because a die cast housing with a coreless water passage is not sufficiently more expensive than a housing without the passage. This is not the case with a cored housing that requires an extra core for the unused water passage. The cost of the extra unused cored passage would require a separate set of casting tooling in any type of volume production.

A die cast bearing housing can be designed to eliminate many of the expensive machining and drilling operations required with other casting methods. Oil passages and bolt holes can be cast to final dimensions, even providing the necessary taper for pipe taps. The inventive configuration has utilized these possibilities in a number of ways. The bearing housing 16 is cast with holes 88 cored for seal plate retaining bolts 90. This approach is unique in that the bolts 90 come through from the turbine side where they can be easily installed. The bolts 90, being blind threaded into the seal plate 40, do not pass completely through the seal plate nor do they require threads in the bearing housing, and cannot form a leak path for oil into the compressor section 12 when vacuum is present, as in some designs. Bearing anti-rotation pads and an oil pressure relief groove can also be cast into the final shape without the need for milling operations. The bearing housing 16 can be completely machined with only turning and tapping operations, with none of the elaborate drilling operations required with other designs.

Figure 5:
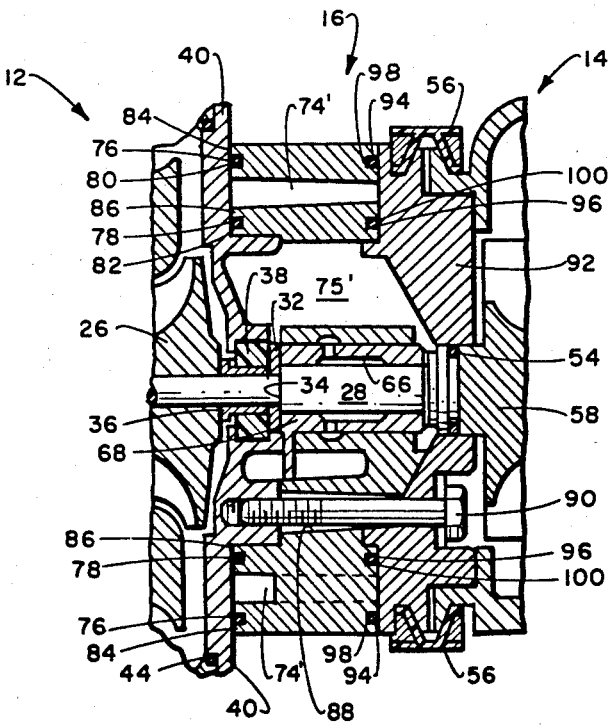
FIG. 5 is a cross-sectional view similar to that of FIG. 4, but depicting an alternate embodiment employing two seal plates.

In an alternate embodiment, the bearing housing 16 may be provided with through channels 74' and 75', as shown in FIG. 5. The first seal plate 40 is employed as above. A second seal plate 92 is provided on the turbine side 14. O-rings 94 and 96 or other sealing materials are seated in grooves 98 and 100, respectively. Again, the O-rings seal the mating joints, here, between the seal plate 92 and the bearing housing 16.

This construction facilitates through water passages. Also, superior materials may be employed on the turbine side for demanding applications. For example, refractory materials might be used in high temperature applications.

The use of a turbine side seal plate 92 provides all the advantages realized with the first seal plate 40, and may be used in conjunction with the first seal plate or separately.

In summary, the apparatus of the invention is unique in that it combines the advantages of die casting with water-cooling to provide a turbocharger that has both superior cooling characteristics and possibly the simplest and least expensive bearing housing presently commerically available.

Thus, there has been disclosed an improved turbocharger water-cooled bearing housing. Those of ordinarily skill in the art will at once recognize various changes and modifications from those which have been disclosed, but all such changes and modifications will not depart from the essence of the invention as disclosed herein, and all such changes and modifications are intended to be covered by the appended claims.

What is claimed is:

1. A turbocharger comprising:

a compressor section provided with a fluid medium inlet, a fluid medium outlet, an annular discharge passage communicating therebetween and a compressor impeller mounted on one end of a shaft;

a turbine section provided with a fluid medium inlet, a fluid medium outlet, an annular inlet passage communicating therebetween and a turbine impeller mounted on the opposite end of said shaft; and a bearing housing, intermediate said compressor section and said turbine section, provided with a lubricating oil inlet passage, means for introducing oil around said shaft, a recess for collecting said oil, and means for discharging said oil, said turbine section clamped to one side of said bearing housing, and means provided between said bearing housing and said compressor section and between said bearing housing and said turbine section for minimizing leakage of oil therebetween;

characterized by a multiple piece die cast bearing housing including said means for introducing oil around said shaft, and at least one water cooling channel including a pair of concentric rings defining an oute rring and an inner ring, said water cooling channel open on at least one side of said compressor section and/or said turbine section, said corresponding section provided with at least one seal plate mounted on said at least one side between said section and said bearing housing, said pair of concentric rings in combination with said seal plate providing a means for preventing leakage between, (1) said water cooling channel and said means for introducing oil around said shaft, said water channel being fluidly isolated from said means for introducing said oil, said inner ring having an inner wall defining said recess for collecting said oil, and (2) said water cooling channel and the environment external said turbocharger, said seal plate mounted to said die cast bearing housing by bolting means passing through said turbine section.

2. The turbocharger of claim 1 in which at least one said channel is open on the compressor side of said bearing housing and a seal plate is mounted between said compressor section and said bearing housing.

3. The turbocharger of claim 2 wherein one side of said seal plate is attached to said compressor section, and the other side of said seal plate is attached to one side of said bearing housing, and the center portion of said seal plate is adapted to support a portion of said oil leakage minimizing means.

4. The turbocharger of claim 3 wherein said seal plate is provided with a plurality of threaded wells, each adapted to threadably receive a threaded bolt and said bearing housing is provided with a corresponding plurality of openings, each adapted to accommodate the shank of said bolt.

5. The turbocharger of claim 2 wherein said said at least one open ended channel is defined by a pair of concentric rings which mate with a surface of said seal plate for sealing said open ended channel to prevent leakage of coolant out of said channel.

6. The turbocharger of claim 5 wherein said pair of concentric rings is provided with sealing means for sealing said channel.

7. The turbocharger of claim 1 in which said at least one channel is open on the turbine side of said bearing housing and a seal plate is mounted between said turbine section and said bearing housing.

8. The turbocharger of claim 1 in which said at least one channel is open on both the compressor side and the turbine side of said bearing housing and a first seal plate is mounted between said compressor section and said bearing housing and a second seal plate is mounted between said turbine section and said bearing housing.

9. The turbocharger of claim 1 wherein at least one of said open ended channels is provided with an inlet means for introducing a coolant thereinto and an outlet means for discharging said coolant therefrom.

10. A turbocharger comprising:

a compressor section provided with a fluid medium inlet, a fluid medium outlet, an annular discharge passage communicating therebetween and a compressor impeller mounted on one end of a shaft;

a turbine section provided with a fluid medium inlet, a fluid medium outlet, an annular inlet passage communicating therebetween and a turbine wheel mounted on the opposite end of said shaft; and a bearing housing, intermediate said compressor section and said turbine section, provide with a lubricating oil inlet passage, means for introducing oil around said shaft and means for discharging said oil, said turbine section clamped to one side of said bearing housing, and means provided between said bearing housing and said compressor section and between said bearing housing and said turbine section for minimizing leakage of oil therebetween;

characterized by a two piece die cast bearing housing comprising a housing member and a seal plate member, said housing member including, (1) means for introducing oil around said shaft, and (2) an open ended water cooling channel defined by a pair of concentric rings having an inner ring and an outer ring, said seal plate member coupled to said compressor section mounted between said compressor section and said housing member, with said pair of concentric rings mating with a surface of said seal plate member for sealing said open ended channel to prevent leakage of coolant out of said channel, said water cooling channel being fluidly isolated from said means for introducing said oil, said inner ring having an inner wall defining said recess for collecting said oil, and said seal plate member bolted to said housing member, where said bolt passes through said turbine section.

11. The turbocharger of claim 10 wherein at least one of said open ended channels is provided with an inlet means for introducing a coolant thereinto and an outlet means for discharging said coolant therefrom.

12. The turbocharger of claim 11 wherein one side of said seal plate is attached to said compressor section, and the other side of said seal plate is attached to one side of said bearing housing, and the center portion of said seal plate is adapted to support a portion of said oil leakage minimizing means.

13. The turbocharger of claim 12 wherein said seal plate is provided with a plurality of threaded wells, each adapted to threadably receive a threaded bolt and said bearing housing is provided with a corresponding plurality of openings, each adapted to accommodate the shank of said bolt.

14. The turbocharger of claim 10 wherein said pair of concentric rings is provided with sealing means for sealing said channel.

15. The turbocharger of claim 8 wherein said bearing housing comprises aluminum and said turbine side sealing plate comprises a refractory material.

* * * * *